US007374667B2

(12) United States Patent
Debuisschert et al.

(10) Patent No.: US 7,374,667 B2
(45) Date of Patent: May 20, 2008

(54) PROCESS FOR THE PRODUCTION OF GASOLINE WITH A LOW SULFUR CONTENT COMPRISING A STAGE FOR TRANSFORMATION OF SULFUR-CONTAINING COMPOUNDS, AN ACID-CATALYST TREATMENT AND A DESULFURIZATION

(75) Inventors: Quentin Debuisschert, Rueil Malmaison (FR); Denis Uzio, Marly le Roy (FR); Jean-Luc Nocca, Houston, TX (US); Florent Picard, Saint Symphorien d'Ozon (FR); David B Arnett, League City, TX (US); Mike Grayson, Houston, TX (US); Donald E Zeek, Dickinson, TX (US); Carl Snider, Houston, TX (US)

(73) Assignees: BP Corporation North America, Inc., Warrensville, IL (US); Institute Francais du Petrole, Rueil Malmaison Cedex (FR)

( * ) Notice: Subject to any disclaimer, the term of this patent is extended or adjusted under 35 U.S.C. 154(b) by 824 days.

(21) Appl. No.: 10/095,293

(22) Filed: Mar. 12, 2002

(65) Prior Publication Data

US 2002/0166798 A1 Nov. 14, 2002

Related U.S. Application Data

(60) Provisional application No. 60/294,594, filed on Jun. 1, 2001, provisional application No. 60/289,812, filed on May 10, 2001, provisional application No. 60/287,389, filed on May 1, 2001.

(30) Foreign Application Priority Data

Mar. 12, 2001 (FR) ..... 01 03358
Apr. 4, 2001 (FR) ..... 01 04618

(51) Int. Cl.
*C10G 45/04* (2006.01)
*C07C 2/54* (2006.01)

(52) U.S. Cl. ..... 208/211; 208/212; 208/88; 208/89; 208/58; 585/259; 585/446

(58) Field of Classification Search ..... 208/88, 208/211, 204, 210, 58, 60, 61, 57, 95, 97; 585/259
See application file for complete search history.

(56) References Cited

U.S. PATENT DOCUMENTS

| | | | | |
|---|---|---|---|---|
| 3,349,027 | A * | 10/1967 | Carr et al. | 208/210 |
| 3,714,030 | A * | 1/1973 | Winsor et al. | 208/210 |
| 4,876,228 | A * | 10/1989 | Chang et al. | 502/71 |
| 5,318,690 | A * | 6/1994 | Fletcher et al. | 208/89 |
| 5,599,441 | A * | 2/1997 | Collins et al. | 208/208 R |
| 5,759,386 | A * | 6/1998 | Frey | 208/217 |
| 6,444,118 | B1 * | 9/2002 | Podrebarac et al. | 208/210 |
| 2002/0175108 | A1 * | 11/2002 | Debuisschert et al. | 208/57 |
| 2003/0042175 | A1 * | 3/2003 | Debuisschert et al. | 208/211 |

FOREIGN PATENT DOCUMENTS

| | | |
|---|---|---|
| EP | 0 755 995 | 1/1997 |
| EP | 1 077 247 | 2/2001 |
| EP | 1 138 749 | 10/2001 |
| FR | 2797639 | 2/2001 |
| WO | 94/22980 | 10/1994 |

OTHER PUBLICATIONS

George A. Olah et al, Hydrocarbon Chemistry, 1995, p. 132.*

* cited by examiner

*Primary Examiner*—Tam M. Nguyen
(74) *Attorney, Agent, or Firm*—Millen, White, Zelano & Branigan, P.C.

(57) ABSTRACT

For the production of gasoline with a low sulfur content, a process comprises at least one stage for transformation of sulfur-containing compounds consisting of an alkylation or adsorption of sulfur-containing compounds and/or an increasing of the weight of light sulfur-containing compounds, at least one stage for treatment in the presence of an acid catalyst and at least one desulfurization treatment of at least a portion of the gasoline. The process can also optionally comprise at least one stage for selective hydrogenation of diolefins and optionally at least one fractionation of the gasoline that is obtained into at least two fractions: light gasoline and heavy gasoline.

22 Claims, 1 Drawing Sheet

Figure 1:
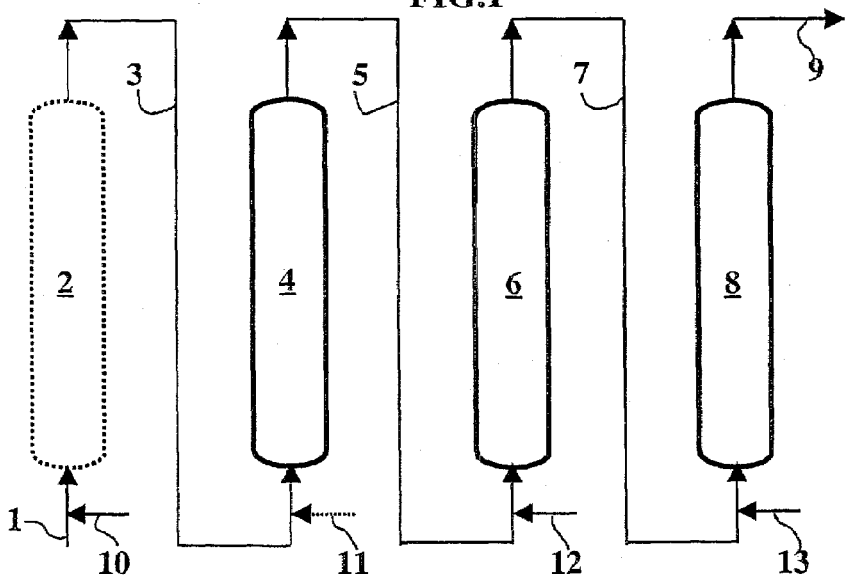

PROCESS FOR THE PRODUCTION OF GASOLINE WITH A LOW SULFUR CONTENT COMPRISING A STAGE FOR TRANSFORMATION OF SULFUR-CONTAINING COMPOUNDS, AN ACID-CATALYST TREATMENT AND A DESULFURIZATION

CROSS-REFERENCE TO RELATED APPLICATION

This application is entitled to the benefit of U.S. Provisional Application Ser. No. 60/289,812 filed May 10, 2001, under the provisions of 35 U.S.C. 119(e) and Ser. No. 10/095,295, entitled "Process For The Production Of Gasoline With A Low Sulfur Content Comprising A Hydrogenation, A Fractionation, A Stage For Transformation Of Sulfur-containing Compounds And A Desulfurization, based on French Application 01/03.358 filed Mar. 12, 2001 and U.S. Provisional Application Ser. No. 60/287,389 filed May 1, 2001, and Ser. No. 10/094,985, entitled "Process For The Production Of A Desulfurized Gasoline From A Gasoline Fraction That Contains Conversion Gasoline", based on French Application 01/03.358 filed Mar. 12, 2001 and French Application 01/05.538 filed Apr. 23, 2001, and U.S. Provisional Application Ser. No. 60/294,594 filed Jun. 1, 2001.

The invention relates to a process for the production of gasoline with a low sulfur content that comprises at least one stage for transformation of sulfur-containing compounds consisting of an alkylation or adsorption of sulfur-containing compounds and/or an increasing of the weight of light sulfur-containing compounds, at least one stage for treatment in the presence of an acid catalyst and at least one desulfurization treatment of at least a portion of the heavy fraction. This process makes it possible to upgrade a gasoline fraction that optionally also comprises hydrocarbons with two, three or four carbon atoms by reducing the total sulfur content of said fraction to very low levels that are compatible with current or future specifications. This desulfurization is furthermore carried out without an appreciable reduction of the gasoline yield and by minimizing the reduction of the octane number.

PRIOR ART

The production of reformulated gasolines that meet new environmental standards requires in particular that their olefin concentration be reduced slightly but that their concentration in aromatic compounds (mainly benzene) and sulfur be reduced to a significant extent. The catalytic cracking gasolines, which may represent 30 to 50% of the gasoline pool, have high olefin and sulfur contents. The sulfur that is present in the reformulated gasolines can be nearly 90%, attributed to the catalytic cracking gasoline (FCC, "Fluid Catalytic Cracking," or fluidized-bed catalytic cracking). The desulfurization (hydrodesulfurization) of gasolines and mainly FCC gasolines is therefore of obvious importance for achieving the specifications.

Hydrotreatment (hydrodesulfurization) of the feedstock that is sent to catalytic cracking produces gasolines that typically contain 100 ppm of sulfur. The hydrotreatment units of catalytic cracking feedstocks operate, however, under severe temperature and pressure conditions, which assumes a significant hydrogen consumption and a high investment. In addition, all of the feedstock should be desulfurized, which involves the treatment of very large volumes of feedstock.

The hydrotreatment (or hydrodesulfurization) of the catalytic cracking gasolines, when it is carried out under standard conditions that are known to one skilled in the art, makes it possible to reduce the sulfur content of the fraction. This process, however, exhibits the major drawback of causing a very significant drop in the octane number of the fraction caused by the saturation of all of the olefins during hydrotreatment.

In contrast, U.S. Pat. No. 4,131,537 teaches that it is advantageous to fractionate the gasoline into several fractions, preferably three, as a function of their boiling point, and to desulfurize them under conditions that may be different and in the presence of a catalyst that comprises at least one metal of group VIB and/or of group VIII. This patent indicates that the greatest benefit is obtained when the gasoline is fractionated into three fractions and when the fraction that has intermediate boiling points is treated under mild conditions.

Patent Application EP-A-0 755 995 describes a process for desulfurization of FCC gasolines that comprises at least two stages. The first is a catalytic hydrodesulfurization at a temperature of between 200 and 350° C. with a desulfurization rate of between 60 and 90%, and it is carried out in the presence of a feedstock that contains less than 0.1% by volume of hydrogen sulfide (H2S). The second, thus optionally the subsequent ones, are also catalytic hydrodesulfurization stages that are operated between 200 and 300° C. and in the presence of a feedstock that comprises less than 0.05% by volume of H2S. The desulfurization rate is between 60 and 90% in this stage. In this process, the H2S concentration should be kept at a very low level. In the event of excess hydrogen being recycled, it is therefore in general necessary to eliminate the H2S, for example by means of an absorption stage with amines, after the second stage and the subsequent ones, so that the recycling gas contains less than 0.1% by volume of H2S. It is also preferred to eliminate the H2S between the first and the second stage to observe the maximum H2S content at the inlet of the second stage (0.05% by volume). For gasolines that are high in sulfur, such an elimination is therefore necessary, taking into account the desulfurization rate that is greater than 60% in the first stage.

Patent Application EP-A-0 725 126 describes a process for hydrodesulfurization of a cracking gasoline in which the gasoline is separated into a number of fractions comprising at least a first fraction that is rich in compounds that are easy to desulfurize and a second fraction that is rich in compounds that are difficult to desulfurize. Before carrying out this separation, it is necessary to determine in advance the distribution of the sulfur-containing compounds by means of analyses. These analyses are necessary for selecting the equipment and the separation conditions.

In this application, it is thus indicated that the olefin content and the octane number of a light cracking gasoline fraction drop significantly when the fraction is desulfurized without being fractionated. In contrast, the fractionation of said light fraction into 7 to 20 fractions, followed by analyses of the sulfur and olefin contents of these fractions, makes it possible to determine the fraction or fractions that are richest in sulfur-containing compounds, which are then desulfurized simultaneously or separately and mixed with other fractions that may or may not be desulfurized. Such a procedure is complex and should be reproduced at each change in the composition of the gasoline that is to be treated.

French Patent 2 785 908 teaches the advantage of fractionating the gasoline into a light fraction and a heavy fraction and then in carrying out a specific hydrotreatment of the light gasoline on a nickel-based catalyst, and a hydrotreatment of the heavy gasoline on a catalyst that comprises at least one metal of group VIII and/or at least one metal of group VIb.

Processes for hydrotreatment of gasolines consisting in fractionating the gasoline, then in introducing the fractions at different levels of a hydrodesulfurization reactor and in converting the desulfurized fractions on a ZSM-5 zeolite to compensate the octane loss that is recorded with an isomerization, have also been proposed, for example, in U.S. Pat. No. 5,290,427. This isomerization is accompanied by a cracking of the gasoline into lighter compounds.

In these processes, the gasolines that are to be treated in general have a starting point that is greater than 70° C., and it is necessary to treat the light gasoline (fraction that corresponds to the compounds with boiling points between C5 hydrocarbons with 5 carbon atoms and 70° C.) separately, for example by softening.

U.S. Pat. No. 5,318,690 proposes a process that comprises a gasoline fractionation and a softening of the light gasoline, while the heavy gasoline is desulfurized, then converted on a ZSM-5 zeolite and desulfurized again under mild conditions. This technique is based on a separation of the crude gasoline to obtain a light fraction that is preferably virtually lacking in sulfur-containing compounds other than the mercaptans. This makes it possible to treat said fraction only with softening that removes the mercaptans.

As a result, the olefins that are present in a relatively large amount in the heavy fraction are partly saturated during the hydrotreatment. To compensate for the drop in the octane number that is associated with the hydrogenation of the olefins, the patent recommends cracking on zeolite ZSM-5 which produces olefins, but to the detriment of the yield. In addition, these olefins can recombine with the $H_2S$ that is present in the medium for reforming mercaptans. It is then necessary to carry out softening or additional hydrodesulfurization.

Patent Application WO 00/15319 describes a process that makes it possible to carry out simultaneously the fractionation and the treatment of a light naphtha. In this process, the light fraction contains mercaptans generally from methylmercaptan to hexyl-mercaptan. These sulfur-containing compounds are eliminated from the light fraction only in the case where the fractionation column contains a hydrodesulfurization section at the top of the column. Without this section, it therefore is not possible to eliminate the mercaptans that either are found in the desulfurized gasoline when the light fraction is recombined with the desulfurized heavy fraction or can be eliminated with the entire light fraction, which brings about a loss of the gasoline yield after desulfurization.

U.S. Pat. No. 6,083,379 describes a process for desulfurization and improvement of the octane number of gasolines comprising a fractionation of the gasoline into at least two fractions, the treatment of the light fraction in the presence of a zeolite, a fractionation of the light fraction that is thus treated, the mixture of the heavy fractions that are obtained during two fractionation stages, and the hydrodesulfurization of the mixture of these fractions.

Patent Application WO 94/22980 describes a process for desulfurization of gasoline that comprises a fractionation into two fractions, the heaviest fraction is desulfurized in a hydrodesulfurization reactor then treated in the presence of an acid catalyst that makes it possible to compensate for the octane loss. The lightest fraction is also desulfurized with a non-hydrogenating extraction of mercaptans.

U.S. Pat. No. 5,968,346 describes a process for hydroconversion of a hydrocarbon-containing feedstock that makes it possible to remove impurities such as compounds that comprise heteroatoms. This process comprises a first stage for hydroconversion of all of the feedstock, followed by a separation of the liquid and the vapor that are present in the effluent of this first stage and bringing a gas into contact with a liquid. The mixture of the two liquid fractions that originate from bringing them into contact and fractionation is then treated in a second hydroconversion stage in the presence of a catalyst.

SUMMARY OF THE INVENTION

This invention relates to a process for the production of gasolines with low sulfur contents, which makes it possible to upgrade the entire gasoline fraction that contains sulfur, preferably a gasoline fraction of catalytic cracking or coking (coking according to English terminology), or pyrolysis, or else visbreaking (according to English terminology), and to reduce the sulfur contents in said gasoline fraction to very low levels, without appreciable reduction of the gasoline yield while minimizing the reduction of the octane number that is caused by the hydrogenation of the olefins. The feedstock of the process according to the invention can also optionally comprise in addition a gasoline fraction, whereby a C4 fraction comprises hydrocarbons with two, three or four carbon atoms.

The process according to the invention is a process for the production of gasoline with a low sulfur content from a gasoline fraction that contains sulfur (starting gasoline). It comprises at least the following stages:

A) at least one stage for transformation of sulfur-containing compounds that are present in gasoline. According to a variant, this transformation is a chemical conversion that is intended to increase weight, i.e., to increase the molecular weight of said sulfur-containing compounds, preferably essentially sulfur-containing compounds that have a boiling point that is lower than that of thiophene. It essentially consists in the addition of mercaptans to the olefins. This stage optionally can be produced simultaneously to stage D for selective hydrogenation and over all or part of the starting gasoline, in the same reactor or a different reactor. It can also be carried out separately over all or part of the gasoline. It can also be carried out simultaneously to the fractionation stage that is described below when the latter is present. In this stage, the thiophene and the thiophenic compounds undergo little or no transformation. According to another variant of the process according to the invention, the stage for transformation of sulfur-containing compounds is a stage for alkylation or adsorption of sulfur-containing compounds that are selected from the group that consists of thiophene, thiophenic compounds and mercaptans, preferably the mercaptans that have 1 to 6 carbon atoms. It is also possible to combine said variants, i.e., both to increase the weight of light mercaptans and to carry out an alkylation or adsorption of thiophene, thiophenic compounds and mercaptans. This stage A is placed before or after stage or stages B and/or D and/or E that are described below when they are present. It can also be carried out simultaneously, i.e., for example, in a reactive column.

B) at least one stage for treatment in the presence of an acid catalyst that is located before or after stages A, B, C, D and/or E, or simultaneously to stage C. The treatment in the presence of an acid catalyst makes it possible to obtain an effluent that has a higher octane number than the feedstock of this stage. The reactions that are produced during this stage are essentially cracking and/or isomerization reactions that produce olefins or branched paraffins that contribute to an increase of the octane number. Any type of acid catalyst can optionally be used, but a catalyst that comprises an alumino-silicate and more preferably a zeolite will preferably be used.

C) at least one desulfurization treatment of at least a portion of the gasoline that is treated in stage A and/or B, and optionally fractionated in stage E or hydrogenated in stage D in the presence of at least one hydrodesulfurization catalyst or an absorbent or an agent making it possible to carry out extractive softening.

The process according to the invention can also comprise:

D) optionally at least one selective hydrogenation of the diolefins that are located before or after stages A, B or E.

E) optionally at least one fractionation of the gasoline that is obtained in stage A or B into at least two fractions, a light fraction that is preferably virtually lacking in sulfur and that contains the lightest olefins of the starting gasoline (light gasoline or light fraction), and a heavy fraction in which preferably the majority of the sulfur-containing compounds that are initially present in the starting gasoline are concentrated (heavy gasoline or fraction). It is also possible to separate the gasoline that is obtained in stage A or B or to separate the untreated feedstock directly into more than two fractions, i.e., for example, a light fraction, at least one intermediate fraction, and a heavy fraction.

F) optionally a stage for mixing the light fraction that is obtained after one of stages A, D or E and optionally with at least one intermediate fraction that originates from one of stages A, B, C or E and with the desulfurized heavy fraction that originates from one of stages A, B, C or E. In this stage, preferably, all of said desulfurized heavy fraction is mixed with said light fraction, without separation of the liquid and the gas contained in the heavy gasoline after desulfurization, optionally simple stripping by a cover gas can be carried out to eliminate the H2S from the totally desulfurized heavy gasoline. In certain specific cases, the upgrading of the light gasoline, the desulfurized heavy gasoline and optionally at least one intermediate gasoline is carried out separately. It is then unnecessary to carry out this stage F.

The feedstock of the process according to the invention is a gasoline fraction that contains sulfur, preferably a gasoline fraction that originates from a unit for catalytic cracking, coking or visbreaking or pyrolysis, whose range of boiling points typically extends from approximately the boiling points of hydrocarbons with 2 or 3 carbon atoms (C2 or C3) up to about 250° C., preferably from approximately the boiling points of hydrocarbons with 5 carbon atoms (C2 or C3) up to about 220° C. The end point of the gasoline fraction depends on the refinery from which it is obtained and market constraints, but it generally remains within the limits that are indicated above.

DETAILED DESCRIPTION OF THE INVENTION

This invention describes a process that makes it possible to obtain a gasoline that preferably originates from a unit for catalytic cracking, coking or visbreaking, or pyrolysis and that has a limited sulfur content. Said process comprises at least one stage for transformation of sulfur-containing compounds consisting in an alkylation or adsorption of the sulfur-containing compounds and/or in an increasing of the weight of the light sulfur-containing compounds, at least one treatment stage in the presence of an acid catalyst and at least one desulfurization treatment of at least a portion of the gasoline. The process according to the invention can also optionally comprise at least one stage for selective hydrogenation of diolefins and optionally at least one fractionation of the gasoline that is obtained in at least two fractions: light gasoline and heavy gasoline.

The simultaneous presence of stage A for transformation of sulfur-containing compounds and stage B for acid treatment makes it possible to obtain in stage C a very intensive desulfurization of the gasoline without excessive reduction of the gasoline yield and while maintaining a high octane number.

Thanks to this process, significant desulfurization rates are achieved under reasonable operating conditions that are specified below.

The optional fractionation point of the gasoline is preferably limited so as to limit the presence of sulfur-containing compounds, in particular thiophenic compounds, in the light gasoline, in particular in the case where the latter are not transformed by alkylation in stage A. In particular, the thiophene that forms azeotropes with a certain number of hydrocarbons cannot be easily separated from the C5 and/or C6 olefins.

In the case where a fractionation is present, to make it possible to recover a light fraction that comprises an important proportion of light olefins that are present in the gasoline while limiting the sulfur content of this fraction, it is preferred to treat the feedstock under conditions and on catalysts that make it possible to transform the sulfur-containing compounds (stage A). The light sulfur-containing compounds and/or thiophenic compounds thus can be transformed into sulfur-containing compounds with higher boiling points that are optionally found, after the optional separation, in at least one intermediate fraction or in the heavy gasoline. These intermediate and/or heavy fractions can then be easily desulfurized. It is also possible to transform the sulfur-containing compounds by means of stage A of the process according to the invention, which comes after fractionation. In this case, a more preferred variant consists in placing an additional fractionation section after stage A and in sending at least one fraction, preferably the heavy fraction, that originates from this fractionation, to the acid treatment stage (stage B) and/or the desulfurization stage (stage C).

The hydrotreatment of gasolines and in particular the hydrodesulfurization, is carried out in the presence of hydrogen under conditions such that at least a portion of the olefins that are present in the feedstock that is to be hydrotreated are hydrogenated. This produces a more or less significant drop of the octane number of the gasoline fraction. The process according to the invention makes it possible, by means of stage A, to limit the content of sulfur-containing compounds in the light fraction of the feedstock. It therefore preferably makes it possible, i.e., when a fractionation is present, to prevent the hydrodesulfurization of this fraction or to carry out desulfurization under mild conditions, for example softening. It is preferred, however, not to fractionate the gasoline before desulfurization or else to treat only some fractions that originate from a fractionation in stage A. In addition, olefins remain in the intermediate and heavy fractions of the gasoline that can be hydrogenated during the desulfurization stage. For all of these reasons, when a very high octane number is sought, it is advantageous to compensate for the reduction of the octane number recorded during desulfurization by means of an acid treatment stage in the presence of an acid catalyst, such as, for example, a zeolite.

The sulfur content of the gasoline fractions that are produced by catalytic cracking (FCC) depends on the sulfur content of the feedstock that is treated with FCC, the presence or absence of a pretreatment of the feedstock of the FCC, as well as the end point of the fraction. Generally, the sulfur contents of the entire gasoline fraction, in particular the ones that are obtained from the FCC, are greater than 100 ppm by weight and most often greater than 500 ppm by weight. For gasolines that have end points that are greater than 200° C., the sulfur contents are often greater than 1,000 ppm by weight, and they can even in some cases reach values on the order of 4,000 to 5,000 ppm by weight.

The process according to the invention applies particularly when high desulfurization rates of the gasoline are required, i.e., when the desulfurized gasoline should contain at most 10% of the sulfur of the starting gasoline and optionally at most 5% and even at most 2% of the sulfur of the starting gasoline that corresponds to desulfurization rates that are greater than 90% and even greater than 95% or else greater than 98%.

It applies more particularly when these desulfurization rates are to be obtained while limiting the reduction of research and motor octane numbers. Thus, the research and motor octane numbers (octane number according to English terminology and called ON below) of the gasoline obtained after treatment by means of the process according to the invention have a value that is generally close to or greater than that of the untreated gasoline. The gasoline that originates from the process according to the invention preferably has a research or motor octane number such that ON $\exists$ $(ON)_o-1$, more preferably ON 3 $(ON)_o-0.7$, very preferably ON $\exists$ $(ON)_o-0.5$, and even more preferably ON $\exists$ $(ON)_o$, whereby $(ON)_o$ represents the value of the research or motor octane number of the feedstock (starting or untreated gasoline).

The process according to the invention comprises at least the following stages:

A) This stage consists in at least one stage for transformation of sulfur-containing compounds that are present in gasoline. According to a variant, this transformation is a chemical conversion that is intended to increase weight, i.e., to increase the molecular weight of said sulfur-containing compounds, preferably essentially sulfur-containing compounds that have a boiling point that is lower than that of thiophene. This stage optionally can be carried out simultaneously to stage D for selective hydrogenation or over all or part of the starting gasoline, in the same reactor or a different reactor. It can also be carried out separately over all or part of the gasoline. It can optionally be carried out simultaneously to the fractionation stage that is described below when the latter is present. In this stage, the thiophene and the thiophenic compounds undergo little or no transformation. According to another variant of the process according to the invention, the stage for transformation of sulfur-containing compounds is a stage for alkylation or adsorption of sulfur-containing compounds that are selected from the group that consists of thiophene, thiophenic compounds and mercaptans, preferably the mercaptans that have 1 to 6 carbon atoms. It is also possible to combine said variants, i.e., both to increase the weight of light mercaptans and to carry out an alkylation or adsorption of thiophene, thiophenic compounds and mercaptans. Said variants can then be carried out in the same reactor or in two different reactors that are placed one after the other, and between which is optionally interposed one or more other reaction sections (according to stages B, C or D) or fractionation sections. This stage A can also be placed before or after stages B, D and/or optionally E that are described below, but preferably located before desulfurization stage C.

B) at least one stage for treatment in the presence of an acid catalyst that is located before or after stages A, C, D and/or E, or carried out simultaneously to stage C. The treatment in the presence of an acid catalyst makes it possible to obtain an effluent that has a higher octane number than the feedstock of this stage. The reactions that are produced during this stage are essentially cracking and/or isomerization reactions that produce olefins or branched paraffins that contribute to an increase of the octane number. Any type of acid catalyst can optionally be used, but a catalyst that comprises an alumino-silicate and more preferably a zeolite will preferably be used.

C) at least one desulfurization treatment of at least a portion of the gasoline that is treated in stage A and/or B, and optionally fractionated in stage E or hydrogenated in stage D in the presence of at least one hydrodesulfurization catalyst or an absorbent or an agent making it possible to carry out extractive softening.

The process according to the invention can also comprise:

D) optionally at least one selective hydrogenation of the diolefins that are located before or after stages A, B, C or E.

E) optionally at least one fractionation of the starting gasoline or the gasoline that is obtained in stage A or B or D into at least two fractions, a light fraction that is preferably virtually lacking in sulfur and that contains the lightest olefins of the starting gasoline (light gasoline or light fraction), and a heavy fraction in which preferably the majority of the sulfur-containing compounds that are initially present in the starting gasoline are concentrated (heavy gasoline or fraction). It is also possible to separate the gasoline that is obtained in stage A or B or to separate the untreated feedstock directly into more than two fractions, i.e., for example, a light fraction, at least one intermediate fraction, and a heavy fraction.

F) optionally a stage for mixing the light fraction that is obtained after one of stages A, B, C, D or E (stages A to E), preferably one of stages A, B, C or E, and more preferably stage A or C, or at the end of an additional fractionation and optionally at least one intermediate fraction that originates from one of stages A to E, preferably stage A or stage C or an additional fractionation, with the desulfurized heavy fraction that originates from one of stages A to E, preferably stage A or stage C. In this stage, preferably, all of said desulfurized heavy fraction is mixed with said light fraction, without separation of the liquid and the gas contained in the heavy gasoline after desulfurization, optionally simple stripping by a cover gas can be carried out to eliminate the H2S from the totally desulfurized heavy gasoline. In certain specific cases, the upgrading of the light gasoline, the desulfurized heavy gasoline and optionally at least one intermediate gasoline is carried out separately. It is then unnecessary to carry out this stage F.

According to a variant of the process according to the invention, it is possible to combine at least one reaction section with a fractionation column according to stage E. Said reaction section or sections then operate on at least one fraction that is sampled inside of the fractionation column, and the effluent of the reaction section is sent to said column. The reaction section or sections thus coupled to the fractionation column of stage E can be selected from the group that consists of the reaction sections of the following stages: transformation of sulfur-containing compounds (stage A), acid treatment (stage B), desulfurization (stage C), hydrogenation of diolefins (stage D) optionally carried out simultaneously to stage A for transformation of sulfur-containing compounds.

Such devices that comprise a fractionation column combined with an external reactor that can be used in the process according to the invention were described, for example, for applications in the field of refining and petrochemistry in U.S. Pat. Nos. 5,1777,283, 5,817,227 and 5,888,355.

According to other variants of the process according to the invention, it is also possible to use a reactive column instead of the fractionation column, i.e., to place at least one of said reaction sections in the fractionation column (reaction section that is inside of the column), preferably in a zone where the reagent concentration is at a maximum. Thus, for example, in the case of stage A for transformation of light sulfur-containing compounds and/or thiophenic compounds, the reaction section will preferably be placed in a zone that exhibits the maximum concentration of these compounds.

According to a preferred variant of the process according to the invention, the reaction section that is inside of the column is selected from the group that consists of the following reaction sections: transformation of sulfur-containing compounds (stage A), acid treatment (stage B), desulfurization (stage C), hydrogenation of diolefins (stage D) optionally carried out simultaneously to stage A for transformation of sulfur-containing compounds.

Such reactive columns are known to one skilled in the art and have been described in, for example, Patents or Patent Applications U.S. Pat. Nos. 5,368,691, 5,523,062, FR 2,737 131, FR 2,737,132, and EP-A-0 461 855.

Another variant of the process according to the invention consists both in using a reactive column that comprises at least one reaction section and an external reactor that may or may not be coupled to said column. Such variants are described in, for example, Patent Application WO 00/15319.

The variants that are described above are only illustrations of possible variants of the process according to the invention. The process according to the invention actually can be used by combining reaction sections either associated with the fractionation column, or inside of said column, or outside and not coupled to said column in that the effluent of said reaction section or sections is not recycled to the fractionation column.

In the process according to the invention, when the fractionation according to stage E is present, the bulk of the olefins are kept in the light fraction, optionally in at least one intermediate fraction that does not require intensive desulfurization. The content of sulfur-containing compounds of the light fraction obtained after fractionation is generally less than 100 ppm, preferably less than 30 ppm, more preferably less than 20 ppm and very preferably less than 10 ppm. When such is not the case, the light fraction is preferably sent into at least one additional section for transformation of the sulfur-containing compounds according to stage A so as to make its content of sulfur-containing compounds less than 50 ppm.

Another advantage resides in the fact that the residual content of sulfur-containing compounds of the desulfurized gasoline by means of the process according to the invention is particularly low and that the octane number of the gasoline is kept at a high level.

The stages of the process according to the invention are described in more detail below.

Transformation of the Sulfur-Containing Compounds (Stage A)

According to a first variant, this stage consists in transforming the light compounds of the sulfur, i.e., the compounds that at the end of an optional separation would be found in the light gasoline, into heavier sulfur-containing compounds that are entrained in the heavy gasoline. The transformed light compounds preferably have a boiling point that is lower than that of thiophene. This first variant essentially consists of an addition of mercaptans to the olefins for forming heavier sulfur-containing compounds and is carried out preferably on a catalyst that comprises at least one element of group VIII (groups 8, 9 and 10 of the new periodic table) or that comprises a resin. The selection of the catalyst is carried out in particular so as to promote the reaction between the light mercaptans and the olefins, which leads to heavier mercaptans.

This stage can optionally be carried out at the same time as hydrogenation stage D, when the latter is present. For example, it may be particularly advantageous to operate, during the hydrogenation of diolefins, under conditions such that at least a portion of the compounds in mercaptan form are transformed. Thus, a certain reduction of the mercaptan content is obtained. To do this, it is possible to use the procedure for hydrogenating the dienes that is described in Patent Application EP-A-0 832 958, which advantageously uses a palladium-based catalyst or the one that is described in Patent FR 2 720 754.

Another possibility is to use a nickel-based catalyst that is identical to or different from the catalyst of stage D, such as, for example, the catalyst that is recommended in the process of U.S. Pat. No. 3,691,066, which makes it possible to transform the mercaptans (butylmercaptan) into heavier sulfur-containing compounds (sulfides).

Another possibility for carrying out this stage consists in hydrogenating at least partly the thiophene into thiophane whose boiling point is greater than that of thiophene (boiling point 121° C.). This stage can be carried out on a catalyst with a nickel, platinum or palladium base. In this case, the temperatures are generally between 100 and 300° C., and preferably between 150 and 250° C. The H2/feedstock ratio is adjusted between 1 and 20 liters per liter, preferably between 3 and 15 liters per liter, to promote, if possible, in addition the desired hydrogenation of the thiophenic compounds and to reduce the hydrogenation of the olefins that are present in the feedstock. The volumetric flow rate is generally between 1 and 10 $h^{-1}$, preferably between 2 and 4 $h^{-1}$, and the pressure is between 0.5 and 5 MPa, preferably between 1 and 3 MPa.

According to a second variant, this stage consists in running the feedstock, optionally hydrogenated in stage D, or optionally a fraction that originates from the fractionation in stage E, preferably the light fraction and/or optionally at least one intermediate fraction that originates from fractionation (stage E), over an absorbent or over a catalyst that has an acid function that makes it possible essentially to carry out the alkylation reaction of thiophene and thiophenic derivatives by the olefins, the addition of sulfur-containing compounds in the form of mercaptans on the olefins. The operating conditions are adjusted to carry out the desired transformation with rates of conversion or adsorption of thiophene and/or thiophenic compounds and/or light mercaptans, preferably mercaptans that have 1 to 6 carbon atoms, greater than 80% by weight, preferably greater than 90% by weight, very preferably greater than 95% by weight. Other compounds such as COS or CS2 can optionally also be adsorbed or converted.

To reduce the oligomerizing activity of the acid catalyst that is optionally used, the gasoline can be supplemented with a known compound for inhibiting the oligomerizing activity of the acid catalysts, such as the alcohols, ethers or water.

This transformation can be performed, for example, according to the procedures and by using the diagrams that are described in French Patent Applications No. 00/08113 and No. 00/10233.

According to this variant of stage A, the optionally hydrogenated gasoline or preferably the light fraction and/or the intermediate fraction optionally obtained in stage E is treated in a section that makes it possible to transform, preferably by alkylation or adsorption, the compounds that are selected from the group that consists of thiophene, thiophenic compounds and mercaptans. In the case of an alkylation, the thiophenic compounds that are contained in the fraction at 60° C.-160° C. will react at conversion rates that are higher than 80% by weight, preferably higher than 90% by weight, with olefins to form thiophene alkyls according to the following reaction for thiophene:

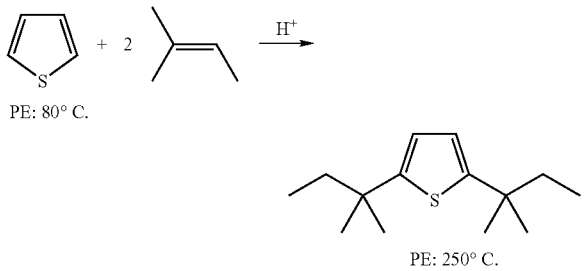

A portion or all of the benzene can also be eliminated by alkylation with the olefins. These compounds of higher molecular weight are primarily characterized by higher boiling points than those that they had before alkylation. Thus, the theoretical boiling point, which is 80° C., is shifted toward 250° C. for the thiophene alkyls.

This alkylation stage is carried out in the presence of acid catalyst. This catalyst can be equally a resin, a zeolite, a clay, any silica that is functionalized or any silico-aluminate that has an acidity, or any grafted substrate of acid functional groups. The ratio of the injected feedstock volume to the catalyst volume is between 0.1 and 10 liters/liter/hour and preferably between 0.5 and 4 liters/liter/hour. More specifically, this alkylation stage is carried out in the presence of at least one acid catalyst that is selected from the group that consists of silicoaluminates, titanosilicates, mixed alumina-titanium compounds, clays, resins, mixed oxides obtained by grafting at least one organometallic compound that is organosoluble or water-soluble (selected from the group that consists of alkys. and/or alkoxy metals of at least one element such as titanium, zirconium, silicon, germanium, tin, tantalum, niobium . . . ) on at least one oxide such as alumina (gamma, delta, eta forms, alone or mixed), silica, alumina silicas, titanium silicas, zirconium silicas or any other solid that has any acidity. A particular embodiment of the invention can consist in using a physical mixture of at least two of the catalysts above in proportions that vary from 95/5 to 5/95, preferably from 85/15 to 15/85 and very preferably from 70/30 to 30/70.

The temperature for this stage is generally between 10 and 350° C. according to the type of catalyst or the force of the acidity. Thus, for an ion-exchanger-type acid resin, the temperature is generally between 50 and 150° C., preferably between 50 and 120° C.

The molar ratio of olefin to thiophenic compounds is between 0.1 and 1000 mol/mol, preferably between 0.5 and 500 mol/mol.

The operating pressure of this stage is generally between 0.1 and 3 MPa and preferably such that the feedstock is in liquid form under the temperature and pressure conditions, or at a pressure that is higher than 0.5 MPa.

The effluent that originates from stage A, for transformation of sulfur-containing compounds, preferably for alkylation or adsorption, can optionally be mixed at least partly with a heavy fraction that originates from the fractionation in stage E.

The effluent that originates from this stage for transformation of the sulfur-containing compounds can also optionally be sent into a new fractionation unit for being separated into two fractions, an intermediate fraction that is not treated or is optionally desulfurized without being mixed, and a heavy fraction that is preferably mixed with the heavy fraction that originates from stage E before being desulfurized in stage C.

For example, effluent D1 that originates from an alkylation can be separated into:

- a fraction at 60° C.-180° C. or 60° C.-100° C. (fraction D2) that is collected and is lacking in any thiophenic compound,
- a fraction whose boiling points are higher than 180° C. or 100° C. (fraction D3) containing thiophenic compounds.

When it is an alkylation, stage A can optionally be advantageously operated on the light fraction that originates from stage E. Actually, the alkylation of the light mercaptans that are present in this fraction then facilitates the desired elimination of the sulfur-containing compounds, but also makes it possible to reduce the vapor pressure (RVP index or Reid Vapor Pressure according to English terminology) of the final desulfurized gasoline.

All of effluent D1 that originates from said alkylation unit or fraction D3 that originates from the fractionation after alkylation can preferably be mixed at least partly with a heavy fraction (for example the H2 fraction) and sent into a desulfurization section according to stage C.

Treatment in the Presence of an Acid Catalyst (Stage B)

This stage makes it possible to compensate for the octane loss caused by the stage for desulfurization of the total gasoline or a gasoline fraction (stage C). It is placed either before said desulfurization stage C or after said stage. It can optionally be used over all of the gasoline before the fractionation stage and before or after the stage for transformation of the sulfur-containing compounds (stage A). It is preferably located after fractionation (stage E) when the latter is present, and more preferably just before or just after the desulfurization stage (stage C). It is finally possible to produce stage B simultaneously to stage C, either by placing an acid catalyst and a hydrodesulfurization catalyst in the same reactor, or by using a bifunctional catalyst that comprises an active desulfurization phase such as that described in stage C, dispersed on a substrate that comprises an acid solid, such as, for example, a zeolite.

When the desulfurization stage is carried out in two separate reactors, it is sometimes preferred to use stage B for acid treatment between the two reactors of stage C. Actually, the second desulfurization reactor makes it possible to remove the mercaptans that are optionally formed in stage B by recombining olefins that are formed in this stage with sulfur-containing compounds. This second desulfurization stage can then be catalytic hydrodesulfurization or softening, for example extractive softening.

When the acid treatment stage is placed after the desulfurization stage, the acid catalyst that is selected for the acid treatment stage has a controlled acidity so as to limit the degree of cracking of the hydrocarbons. As a result, the cracking reaction is essentially limited to compounds that have a low octane number.

This acid treatment stage preferably carries out a limited cracking of paraffins with a low octane number to form products with a higher octane number. The reactions in question are, on the one hand, the cracking of paraffins that have the highest boiling points into paraffins of lower boiling point, and the cracking of paraffins with a low octane number. Olefins are also formed during these reactions, as well as paraffins that are branched via isomerization reactions. All of these reactions therefore make it possible to compensate for the reduction of the octane number caused by the desulfurization stage, and even in some cases to increase this number beyond the number of the fraction or the gasoline before desulfurization.

To limit the deactivation of the catalyst by deposition of hydrocarbons, hydrogen is generally injected into the acid treatment reactor. It is also possible to admit excess hydrogen that originates from a preceding stage (for example a desulfurization stage) at the inlet of this stage, optionally with an addition of hydrogen provided by a separate feed.

The operating conditions of this stage are generally as follows: the temperature is generally between 140° C. and 500° C., preferably between 170° C. and 480° C.; the pressure is generally between 0.5 and 15 MPa, preferably between 1 and 10 MPa, more preferably between 2 and 8 MPa; the volumetric flow rate that is expressed by volume of feedstock per volume of catalyst and per hour is generally between 0.3 and 15 h−1, preferably between 0.5 and 10 h−1; the hydrogen to hydrocarbon-containing feedstock volumetric ratio is generally between 0 and 1000 liters per liter, preferably between 10 and 800 liters per liter, more preferably between 20 and 500 liters per liter.

Among the catalysts that are preferred for each stage, it is possible to cite the silicates, aluminosilicates, borosilicates, gallosilicates, and in general metallosilicates. Among the aluminosilicates, those that belong to the family of ZSM (for example ZSM-5, ZSM-12, ZSM 22) or MCM (for example MCM-22) are preferred, as well as the Y zeolite, the mordenite, the beta zeolite or the faujasites. To adjust the acidity of these materials, they can optionally be at least partially dealuminified or synthesized in fluoride medium.

The catalysts of this stage can also comprise an active metal in terms of hydrogenation so as to facilitate the elimination of compounds that can poison the catalyst and in particular its acid function. A metal of group VIII of the former periodic table (groups 8, 9, 10 of the new table) is preferably used, for example a noble metal or nickel.

Desulfurization (Stage C)

This stage can be, for example, a hydrodesulfurization stage that is carried out by running heavy gasoline or intermediate gasoline, in the presence of hydrogen, over at least one catalyst that comprises at least one element of group VIII and/or at least one element of group VIb at least partly in sulfide form, at a temperature of between about 210° C. and about 350° C., preferably between 220° C. and 320° C., under a pressure that is generally between about 1 and about 4 MPa, preferably between 1.5 and 3 MPa. The volumetric flow rate of the liquid is between about 1 and about 20 $h^{-1}$ (expressed by volume of liquid per volume of catalyst and per hour), preferably between 1 and 10 h−1, very preferably between 3 and 8 h−1. The $H_2$/HC ratio is between 100 to 600 liters per liter and preferably between 300 and 600 liters per liter.

The metal content of group VIII that is expressed in oxide is generally between 0.5 and 15% by weight, preferably between 1 and 10% by weight. The metal content of group VIb is generally between 1.5 and 60% by weight, preferably between 3 and 50% by weight.

The element of group VIII, when it is present, is preferably cobalt, and the element of group VIb, when it is present, is generally molybdenum or tungsten. Combinations such as cobalt-molybdenum are preferred. The substrate of the catalyst is usually a porous solid, such as, for example, an alumina, a silica-alumina or other porous solids, such as, for example, magnesia, silica or titanium oxide, alone or mixed with alumina or silica-alumina. The catalyst according to the invention preferably has a specific surface area that is less than 190 m2/g, more preferably less than 180 m2/g, and very preferably less than 150 m2/g.

After introduction of the element or elements and optionally after the catalyst is shaped (when this stage is carried out on a mixture that already contains the basic elements), the catalyst is in a first activated stage. This activation may correspond either to an oxidation, then to a reduction, or to a direct reduction, or to a calcination alone. The calcination stage is generally carried out at temperatures of from about 100 to about 600° C. and preferably between 200 and 450° C., under an air flow. The reduction stage is carried out under conditions that make it possible to convert at least a portion of the oxidized forms of base metal into metal. It generally consists in treating the catalyst under a hydrogen flow at a temperature that is preferably at least equal to 300° C. The reduction can also be carried out partly with chemical reducing agents.

The catalyst is preferably used at least in part in its sulfurized form. The introduction of the sulfur can take effect before or after every activation stage, i.e., calcination or reduction stage. Preferably, no oxidation stage of the catalyst is carried out when the sulfur or a sulfur-containing compound has been introduced onto the catalyst. The sulfur or a sulfur-containing compound can be introduced ex situ, i.e., apart from the reactor where the process according to the invention is carried out, or in situ, i.e., in the reactor that is used for the process according to the invention. In the latter case, the catalyst is preferably reduced under the conditions that are described above, then sulfurized by passage of a feedstock that contains at least one sulfur-containing compound, which, once decomposed, results in the attachment of sulfur to the catalyst. This feedstock can be gaseous or liquid, for example hydrogen that contains $H_2S$, or a liquid that contains at least one sulfur-containing compound.

In a preferred way, the sulfur-containing compound is added to the catalyst ex situ. For example, after the calcination stage, a sulfur-containing compound can be introduced onto the catalyst optionally in the presence of another compound. The catalyst is then dried, and transferred into the reactor that is used to implement the process according to the invention. In this reactor, the catalyst is then treated under hydrogen to transform at least a portion of the main metal into sulfide. A procedure that is especially suitable to the invention is the one that is described in Patents FR-B-2 708 596 and FR-B-2 708 597.

The desulfurization of the heavy gasoline and/or at least one intermediate gasoline can also be carried out by means of an absorber that comprises an absorbent mass, for example with a zinc oxide base. Said desulfurization can also be carried out by means of a combination between a hydrodesulfurization section and an absorber, preferably located after the hydrodesulfurization section.

The desulfurization section can optionally comprise at least two reactors in series, optionally with a separation of the gas that contains H2S and liquid between the two reactors. It is also possible to use two catalysts that are identical or different that are placed in at least two beds inside of a single reactor or in two reactors comprising a single catalyst bed or several catalyst beds. An intermediate hydrogen addition (also called quench according to English terminology) is also possible between said reactors and/or between two beds.

For example, it is possible to use a catalyst that comprises cobalt and molybdenum or tungsten associated with a catalyst that comprises nickel in the same reactor or in two different reactors that are placed in series. Said catalysts are preferably sulfurized.

One of the preferred embodiments of desulfurization of at least one intermediate fraction or heavy fraction or total gasoline consists in, for example, operating in two stages: a first stage that essentially carries out the hydrogenation of unsaturated sulfur-containing compounds and a second stage that carries out a decomposition of saturated sulfur-containing compounds, according to one of the operating procedures taught in Patent Application EP-A-1 031 622.

It is also possible, preferably for fractions that are least rich in sulfur-containing compounds, in particular the light fraction that is obtained after the optional fractionation stage, to carry out simple softening by means of any softening process that is known to one skilled in the art. It thus is possible to use a process for softening by oxidation with air, optionally in the presence of copper, or else by an extractive process by liquid/liquid contact, for example by a soda solution. Other processes for catalytic conversion of mercaptans into disulfide can also be used by combination if necessary with an additional fractionation after softening.

Hydrogenation of Diolefins (Optional Stage D)

The hydrogenation of dienes is an optional stage that makes it possible to eliminate, before hydrodesulfurization, almost all of the dienes that are present in the gasoline fraction that contains the sulfur to be treated. It preferably takes place in the first stage of the process according to the invention, or optionally on at least one of the fractions that are obtained just after fractionation in stage E. It is generally carried out in the presence of a catalyst that comprises at least one metal of group VIII, preferably selected from the group that consists of platinum, palladium and nickel, and a substrate. For example, a nickel-based or palladium-based catalyst that is deposited on an inert substrate, such as, for example, alumina, silica or a substrate that contains at least 50% of alumina, will be used.

The pressure that is used is adequate for maintaining more than 60%, preferably 80%, and more preferably 95% by weight of the gasoline that is to be treated in liquid phase in the reactor; it is most generally between about 0.4 and about 5 MPa and preferably greater than 1 MPa, more preferably between 1 and 4 MPa. The hourly volumetric flow rate of the liquid that is to be treated is between about 1 and about 20 $h^{-1}$ (volume of feedstock per volume of catalyst and per hour), preferably between 2 and 10 $h^{-1}$, very preferably between 3 and 8 $h^{-1}$. The temperature is most generally between about 50 and about 250° C., and preferably between 80 and 220° C., and more preferably between 100 and 200° C., to ensure an adequate conversion of diolefins. Very preferably, it is limited to 180° C. The hydrogen to feedstock ratio that is expressed in liters is generally between 1 and 50 liters per liter, preferably between 3 and 30 liters, more preferably between 8 and 25 liters per liter.

The selection of operating conditions is particularly important. The operation most generally will be performed under pressure and in the presence of an amount of hydrogen that slightly exceeds the stoichiometric value that is necessary for hydrogenating the diolefins. The hydrogen and the feedstock that is to be treated are injected in upward or downward flows in a reactor that preferably comprises a fixed catalyst bed.

Another metal can be combined with the main metal to form a bimetallic catalyst, such as, for example, molybdenum or tungsten. The use of such catalytic formulas has been claimed in, for example, Patent FR 2 764 299.

The catalytic cracking gasoline can contain up to several % by weight of diolefins. After hydrogenation, the diolefin content is generally reduced to less than 3000 ppm, and even less than 2500 ppm and more preferably less than 1500 ppm. In some cases, less than 500 ppm can be obtained. The diene content after selective hydrogenation can even, if necessary, be reduced to less than 250 ppm.

According to a particular embodiment of the process according to the invention, the hydrogenation stage of the dienes takes place in a catalytic hydrogenation reactor that comprises a catalytic reaction zone that is traversed by all of the feedstock and the amount of hydrogen that is necessary to carry out the desired reactions.

Separation of the Gasoline into at Least Two Fractions (Optional Stage E)

According to a first variant of the process according to the invention, the gasoline is optionally fractionated into two fractions:

- a light fraction that contains a limited residual sulfur content, preferably less than about 100 ppm, more preferably less than about 50 ppm, very preferably less than about 20 ppm, and that makes it possible to use this fraction without carrying out other treatment that aims at reducing its sulfur content, except optionally a transformation of sulfur-containing compounds according to stage A, or simple softening.

a heavy fraction in which the bulk of the sulfur that is initially present in the feedstock is preferably concentrated.

This separation is preferably carried out by means of a standard distillation column that is also called a splitter.

This fractionation column should make it possible to separate a light fraction of the gasoline that contains a small fraction of sulfur and a heavy fraction that preferably contains the bulk of the sulfur that was initially present in the starting gasoline.

This column generally operates at a pressure of between 0.1 and 2 MPa and preferably between 0.2 and 1 MPa. The number of theoretical plateaus of this separation column is generally between 10 and 100 and preferably between 20 and 60. The reflux rate, which is expressed as being the ratio of the liquid flow rate in the column that is divided by the flow of distillate, expressed in kg/h, is generally less than the unit and preferably less than 0.8.

The light gasoline that is obtained at the end of the separation generally contains at least all of the C5 olefins, preferably the C5 compounds and at least 20% of the C6 olefins. Generally, this light fraction has a low sulfur content, i.e., it is generally unnecessary to treat the light fraction before using it as a fuel.

According to a second variant of the process according to the invention, the gasoline is fractionated into at least 3 fractions: a light fraction, a heavy fraction and at least one intermediate fraction.

In the case where the transformation of thiophenic compounds according to stage A is present in the process according to the invention, the gasoline is preferably fractionated into at least two fractions that exhibit the following properties:

a so-called light fraction (fraction L) whose boiling points are preferably less than about 60° C. This temperature is given by way of example; it is preferably the maximum temperature for which the thiophene content is less than 5 ppm, at least one so-called heavy fraction (fraction H1), whose boiling points are greater than about 60° C.

Light fraction L is preferably injected into a flask for gas-liquid separation to separate the unconsumed hydrogen and optionally the H2S that is present, whereby olefins generally have 5 to 7 carbon atoms. It can then optionally be treated according to stage C, preferably by means of simple softening.

So-called heavy fraction H1, i.e., the fraction whose temperatures are greater than about 60° C., is sent into a distillation column or any other separation process that can separate this fraction into at least two fractions:

intermediate fraction 12 whose boiling points by way of example are at least 60° C. and at most about 120° C. and even about 160° C. This fraction can be treated in stage A and optionally B and/or C of the process according to the invention.

a heavier fraction H2 whose boiling points are generally greater than about 160° C. or about 120° C.

Heavy fraction H2 whose boiling points are generally greater than about 150° C. or even about 180° C. is sent to stage C for desulfurization.

In another version of the process according to the invention, it is also possible to fractionate the gasoline directly into at least three fractions: a light fraction (L), at least one intermediate fraction (I2), and at least one heavy fraction (H2) that exhibits the properties that are described above.

Intermediate fraction I2 whose boiling points are between about 60° C. and about 120° C. or about 160° C. can be sent into a transformation unit of sulfur-containing compounds according to stage A.

After stage A, fractions I2 can again be fractionated into an intermediate fraction I3 and a heavy fraction H3, in particular when stage A is a stage for alkylation of the thiophenic compounds. Fraction H3 that is thus obtained can optionally be mixed with fraction H2, preferably before desulfurization.

Figure 2:
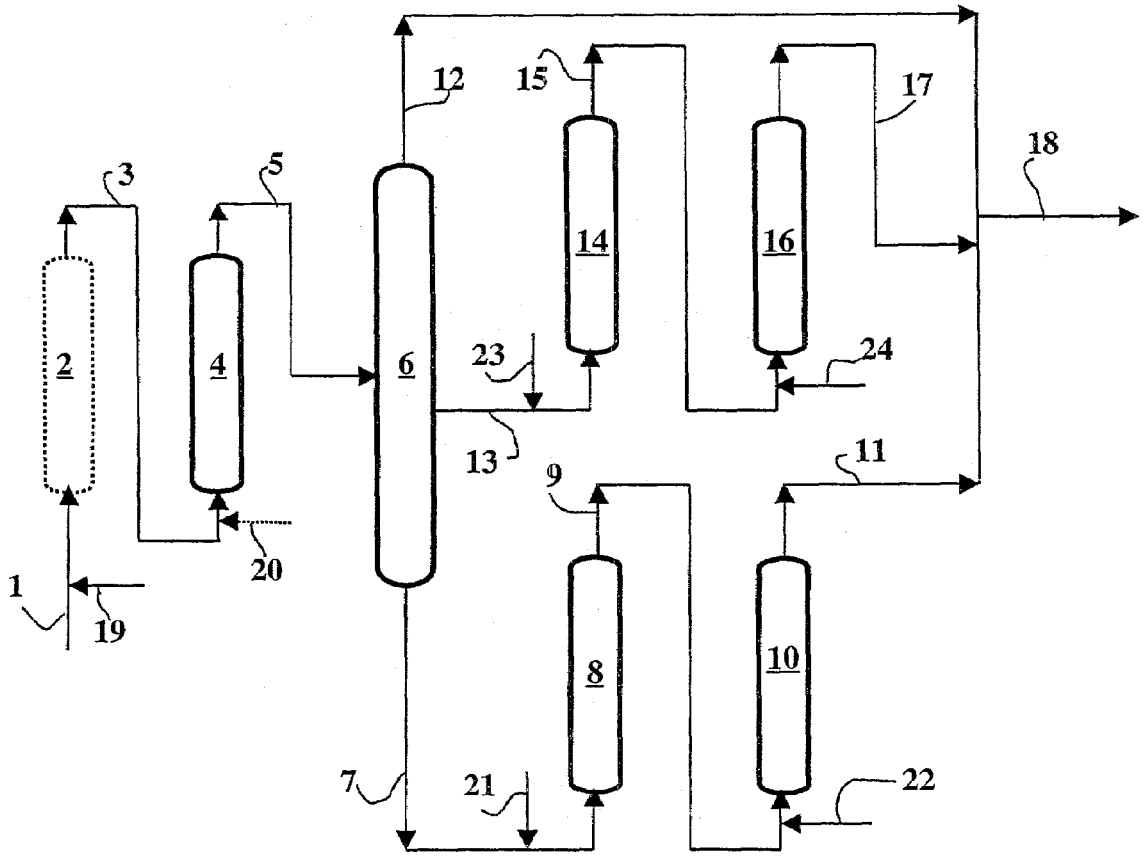

Two possible variants of the process according to the invention are illustrated by FIGS. 1 and 2. In the variant of FIG. 1, the process according to the invention does not comprise a fractionation stage. First of all, feedstock 1 is optionally and preferably sent into hydrogenation unit 2 according to stage D. This reaction section can optionally comprise a catalyst that can both hydrogenate the diolefins (stage D) and increase the weight of sulfur-containing compounds, in particular the light mercaptans, by addition to the olefins (stage A, first variant). The effluent that originates from this section 2 or the feedstock, when section 2 is absent, is sent via pipe 3 to a reaction section 4 that makes it possible to carry out the alkylation of thiophenic compounds (stage A, second variant). The effluent of section 4 is then sent via pipe 5 to a section 6 that contains a hydrodesulfurization catalyst. The desulfurized effluent that originates from this section (7) is finally sent into a reaction section that contains an acid catalyst (section 8) and that makes it possible to carry out essentially a light cracking and other reactions that are described according to stage B to increase the octane number of the desulfurized gasoline. The hydrogen that is necessary to sections 2, 6 and 8 can be brought out respectively via pipes 10, 12 and 13. It is optionally possible to bring out via line 11 a hydrocarbon-containing fraction that is rich in olefins that originate from another process to facilitate the alkylation of thiophenic compounds in section 4. Effluent 9 that originates from this treatment can be used in a gasoline pool because it has a low content of sulfur-containing compounds and a high octane number.

In the variant of FIG. 2, the process according to the invention comprises a fractionation stage. First of all, feedstock 1 is optionally and preferably sent into hydrogenation unit 2 according to stage D. This reaction section can optionally comprise a catalyst that can both hydrogenate the diolefins (stage D) and increase the weight of sulfur-containing compounds, in particular the light mercaptans (stage A). The effluent that originates from this section 2 or the feedstock, when section 2 is absent, is sent via pipe 3 to a reaction section 4 that makes it possible to carry out the alkylation of thiophenic compounds (stage A). The effluent of section 4 is then sent via pipe 5 to a fractionation section 6 (stage E) in three fractions: a light fraction that is not treated and is recovered via pipe 12, an intermediate fraction that is recovered via pipe 13 then treated, a heavy fraction that is recovered via pipe 7 and then treated. The treatment of intermediate fraction (13) first of all consists of an acid treatment (stage B) in section 14, then a hydrodesulfurization in the presence of a catalyst in section 16 (stage C) of the effluent that originates from section 14 (effluent 15). The treatment of the heavy fraction consists of a hydrodesulfurization in the presence of a catalyst in section 8 (stage C), then an acid treatment of desulfurized effluent 9 in section 10 (stage B). The hydrogen that is necessary for sections 2, 8, 10, 14 and 16 can be brought out respectively via pipes 19, 21, 22, 23, and 24. It is also possible to bring out via line 20 an olefin-rich hydrocarbon-containing fraction that originates from another process to facilitate the alkylation of thiophenic compounds in section 4. The intermediate and heavy fractions that are thus desulfurized and that have a high octane number thanks to the acid treatment are recovered respectively via pipes 17 and 11 and mixed with light fraction 12 to form a desulfurized gasoline 18 that has a high octane number.

In summary, the invention relates to a process for the production of gasoline with a low sulfur content that comprises at least one stage for transformation of sulfur-containing compounds (stage A), at least one treatment stage in the presence of an acid catalyst (stage B), and at least one desulfurization treatment of at least a portion of the gasoline (stage C). Said process can optionally also comprise at least one stage for selective hydrogenation of diolefins (stage D). It can also optionally comprise at least one stage for fractionation of gasoline (stage E) into at least two fractions. It can also optionally comprise at least one fractionation of the gasoline into at least three fractions.

According to a preferred embodiment of the process according to the invention, the stage for transformation of sulfur-containing compounds (stage A) comprises an alkylation or an adsorption of the sulfur-containing compounds. According to a more preferred embodiment, said stage essentially consists of an alkylation of thiophenic compounds. According to another preferred embodiment, the transformation stage of the sulfur-containing compounds (stage A) essentially consists of an addition of mercaptans to the olefins. According to a very preferred embodiment, the stage for transformation of sulfur-containing compounds (stage A) comprises both an alkylation of the thiophenic compounds and an addition of mercaptans to the olefins that are produced in two separate reaction sections. Optionally, the stage for increasing the weight of the sulfur-containing compounds (stage A) is carried out in the same reaction section as the hydrogenation stage of the diolefins (stage D).

The process according to the invention can also comprise a mixing stage (stage F) of the light fraction that is obtained after one of stages A to E and optionally at least one intermediate fraction that originates from one of stages A to E with the desulfurized heavy fraction that originates from one of stages A to E.

According to a preferred variant of the process according to the invention, the heavy gasoline is desulfurized in the presence of at least one hydrodesulfurization catalyst or an absorbent.

According to another variant, the heavy gasoline is desulfurized in two hydrodesulfurization reactors that are placed in series and that comprise a hydrodesulfurization catalyst. In this case, H2S is preferably stripped between the two hydrodesulfurization reactors. According to another variant of the process according to the invention, an acid treatment stage (stage B) is interposed between the two hydrodesulfurization reactors. Optionally, by means of any of the described variants, the desulfurized heavy gasoline is stripped by means of a cover gas.

Optionally, at least one reaction section of the process according to the invention is inside the fractionation section and selected from the group that consists of the following reaction sections: transformation of sulfur-containing compounds (stage A), acid treatment (stage B), desulfurization (stage C), diolefin hydrogenation (stage D) optionally carried out simultaneously to stage A for transformation of sulfur-containing compounds.

Optionally, at least one reaction section is coupled to the fractionation section and selected from the group that consists of the following reaction sections: transformation of sulfur-containing compounds (stage A), acid treatment (stage B), desulfurization (stage C), diolefin hydrogenation (stage D) optionally carried out simultaneously to stage A for transformation of sulfur-containing compounds.

According to one of the preferred variants of the process according to the invention, at least one effluent that originates from stage A for transformation of sulfur-containing compounds is sent into a second fractionation section to be separated into two fractions, one intermediate fraction that is not treated or optionally desulfurized (stage C), and one heavy fraction that is preferably mixed with the heavy fraction that originates from the first fractionation section (stage E) or stage B for acid treatment, before desulfurization in stage C.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French applications 01/03.358 and 01/04.618, and U.S. Provisional Application No. 60/289,812, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

The invention claimed is:

1. A process for the production of gasoline with a low sulfur content that comprises subjecting a sulfur-containing gasoline fraction to at least one alkylation of thiophenic compounds (stage A), at least one cracking and/or isomerization of saturated hydrocarbons in the presence of an acid catalyst to form olefins and/or branched paraffins (stage B) and at least one desulfurization treatment of at least a portion of the gasoline (stage C), wherein cracking/isomerization (B) is performed on the effluent of a desulfurization (C), and effluent of (B) is not subjected to further hydrodesulfurization.

2. A process according to claim 1 further comprising at least one selective hydrogenation of diolefins (stage D).

3. A process according to claim 1, further comprising at least one fractionation of resultant gasoline (stage E) into at least two fractions, at least one light fraction and at least one heavy fraction.

4. A process according to claim 3, comprising at least one fractionation of gasoline into at least three fractions.

5. A process according to claim 2, in which (stage A) is carried out in the same reaction section as the hydrogenation stage of the diolefins (stage D).

6. A process according to claim 3, further comprising a mixing stage (stage F) of a resultant light fraction obtained after one of stages (A) to (E) and optionally at least one intermediate fraction that originates from one of stages (A) to (E) with a resultant desulfurized heavy fraction that originates from one of stages (A) to (E).

7. A process according to claim 3, in which a heavy gasoline fraction is desulfurized in the presence of at least one hydrodesulfurization catalyst or one absorbent.

8. A process according to claim 7, in which the heavy gasoline fraction is desulfurized in two hydrodesulfurization reactors placed in series, each comprising a hydrodesulfurization catalyst.

9. A process according to claim 8, in which $H_2S$ is stripped from said heavy gasoline fraction between the two hydrodesulfurization reactors.

10. A process according to claim 1, further comprising stripping the desulfurized heavy gasoline with a stripping gas.

11. A process according to claim 3, in which at least one reaction zone is incorporated within the fractionation stage, said reaction zone comprising: alkylation of thiophenic compounds (stage A), acid treatment, desulfurization (stage C), or a diolefin hydrogenation (stage D) optionally carried out simultaneously to stage (A) for transformation of sulfur-containing compounds.

12. A process according to claim 3, in which at least one reaction zone is coupled to the fractionation stage, said reaction zone comprising: alkylation of thiophenic compounds (stage A), acid treatment, desulfurization (stage C), or a diolefin hydrogenation (stage D) optionally carried out simultaneously to stage A for transformation of sulfur-containing compounds.

13. A process for the production of gasoline with a low sulfur content that comprises subjecting a sulfur-containing gasoline fraction to at least one transformation of sulfur-containing compounds (stage A), at least one cracking and/or isomerization of saturated hydrocarbons in the presence of an acid catalyst to form olefins and/or branched paraffins (stage B) and at least one desulfurization treatment of at least a portion of the gasoline (stage C), wherein cracking/isomerization (B) is performed on the effluent of a desulfurization (C), and effluent of (B) is not subjected to further hydrodesulfurization, and in which at least one effluent from stage (A) is sent into a second fractionation section to be separated into two fractions: an intermediate fraction that is not treated or is optionally desulfurized (stage C), and a heavy fraction that is mixed with the heavy fraction that originates from a fractionation (stage E) of gasoline into at least two fractions, at least one light fraction and at least one heavy fraction or from acid treatment, before desulfurization in stage (C).

14. A process according to claim 13, in which the transformation of sulfur-containing compounds (stage A) comprises an alkylation or an adsorption of sulfur-containing compounds.

15. A process according to claim 14, in which said stage (A) consists essentially of an alkylation of thiophenic compounds.

16. A process according to claim 14, in which stage (A) for transformation of sulfur-containing compounds (stage A) consists essentially of an addition of mercaptans to the olefins.

17. A process according to claim 14, in which the (stage A) comprises both an alkylation of thiophenic compounds and an addition of mercaptans to the olefins produced in two separate reaction sections.

18. A process for the production of gasoline with a low sulfur content that comprises subjecting a sulfur-containing gasoline fraction to at least one transformation of sulfur-containing compounds (stage A), at least one cracking and/or isomerization of saturated hydrocarbons in the presence of an acid catalyst to form olefins and/or branched paraffins (stage B) and at least one desulfurization treatment of at least a portion of the gasoline (stage C), wherein in stage (A) is conducted before stage (C) and stage (C) is conducted before stage (B), and wherein effluent of (B) is not subjected to further hydrodesulfurization.

19. A process according to claim 18, further comprising a stage prior to stage (A) comprising selective hydrogenation of diolefins stage (D).

20. A process for the production of gasoline with a low sulfur content that comprises subjecting a sulfur-containing gasoline fraction to at least one transformation of sulfur-containing compounds (stage A), at least one cracking and/or isomerization of saturated hydrocarbons in the presence of an acid catalyst to form olefins and/or branched paraffins (stage B) and at least one desulfurization treatment of at least a portion of the gasoline (stage C), further comprising after stage (A) but before stages (B) and (C), fractionation of gasoline into at least three fractions including an intermediate fraction and a heavy fraction, treating the intermediate fraction in accordance with stage (B) and subsequently treating the according to stage (C), further comprising treating the heavy fraction first according to stage (C) and the effluent therefrom in accordance with stage (B), wherein the effluent of stage (B) is not subjected to further hydrodesulfurization.

21. A process according to claim 20, further comprising a stage prior to stage (A) comprising selective hydrogenation of diolefins stage (D).

22. A process according to claim 20, further comprising a stage prior to stage (A) comprising selective hydrogenation of diolefins stage (D).

* * * * *